US005125004A

United States Patent [19]

Roberts et al.

[11] Patent Number: 5,125,004

[45] Date of Patent: Jun. 23, 1992

[54] VACUUM INDUCTION MELTING ASSEMBLY HAVING SIMULTANEOUSLY ACTIVATED COOLING AND POWER CONNECTIONS

[75] Inventors: Raymond J. Roberts, West Berlin; Robert L. Danley, Jr., Collingswood, both of N.J.

[73] Assignee: Consarc Composition, Rancocas, N.J.

[21] Appl. No.: 647,875

[22] Filed: Jan. 30, 1991

[51] Int. Cl.[5] ..... F27D 3/00

[52] U.S. Cl. ..... 373/143; 373/152; 373/153; 373/154; 373/156; 219/10.491; 174/15.1

[58] Field of Search ..... 373/143, 154, 156, 158, 373/93, 4.9, 48, 59, 72, 74, 75, 76, 79, 84, 152; 174/15 R, 15.1, 19, 40 R, 169; 219/10.49, 10.491; 75/527; 266/158

[56] References Cited

U.S. PATENT DOCUMENTS

| | | | |
|---|---|---|---|
| 2,433,495 | 12/1947 | Vogel | 373/152 |
| 2,932,682 | 4/1960 | Barrass | 174/19 |
| 3,021,380 | 2/1962 | Barrass | 174/15 |
| 3,784,722 | 1/1974 | Goodman | 174/15 |
| 3,935,412 | 1/1976 | McDonough et al. | 219/10.49 |
| 4,058,668 | 11/1977 | Clites | 373/76 |
| 4,129,845 | 12/1978 | Benke | 174/15 R |
| 4,183,508 | 1/1980 | Michelet et al. | 373/156 |

FOREIGN PATENT DOCUMENTS

| | | | |
|---|---|---|---|
| 1145769 | 3/1969 | United Kingdom | 373/156 |

*Primary Examiner*—Bruce A. Reynolds
*Assistant Examiner*—Tu Hoang
*Attorney, Agent, or Firm*—Seidel, Gonda, Lavorgna & Monaco

[57] ABSTRACT

A power activated assembly is disclosed that provides rapid and simultaneous disconnection and reconnection of water cooled power connectors to and from an induction furnace of a melting assembly which is tiltable about the axis of its trunnion. The power activated assembly carries extensions that have respective female connectors on the end and which have flexible conductors connected for supplying electrical power and cooling water to the induction furnace. The housing is positioned concentric with the trunnion so as to allow its female connectors to mate with corresponding male connectors of the assembly when the housing is axially moved toward and along the trunnion axis in response to motion control means such as a power activated device. The male connectors are distributed on the assembly about and inside the circumference of the trunnion. In one embodiment, the male and female connectors have flow control means such as shut-off valves which allow the water to flow from the coolant supply source to the vacuum furnace when the connectors are engaged and terminates such flow when the connectors are disengaged. The power activated assembly of the present invention reduces the time needed to remove the crucible of the assembly or to exchange the introduction furnace of the assembly.

18 Claims, 5 Drawing Sheets 30
26
32
48
34
46
36
38A
6
38C
40
44
38
38B
2
44
6
42
2
24
24A
10
22
20
22
16A
16
28
14
20A
22A
24
16
22A
50
3
12
52
15
18A
18
18A
16B
16B
3

56
72A
72
70
72B
70
68
74
76
70
72C
22B
22
74
82
90
76
80
84
86
92
22A
90
62
65
88
66
68
64
4
60
4
56
18
56A
80
82
54B
52
18A
168
54
54A
18B
96
98
100
102

VACUUM INDUCTION MELTING ASSEMBLY HAVING SIMULTANEOUSLY ACTIVATED COOLING AND POWER CONNECTIONS

BACKGROUND OF THE INVENTION

The invention relates to a vacuum induction melting furnace, and more particularly, to means for simultanesously and rapidly connecting or disconnecting the power and the cooling sources to and from the vacuum induction melting furnace.

Vacuum induction melting is a well-established technology for the production of the high performance alloy metlas. The vacuum induction melting assembly comprises an induction melting furnace located within a vacuum chamber and a ceramic refractory crucible. The melting is accomplished by induction furnaces such as that disclosed in U.S. Pat. No. 2,433,495 of P. C. Vogel, which is herein incorporated by reference. The '495 patent discloses an induction furnace which is tiltable about a trunnion that is rotatably supported on a bearing. The furnace is tiltable so that the finished product, contained in the crucible, is pourable from the furnace.

In practice, the induction melting furnace is frequently removed from the vacuum chamber to replace or repair the crucible or to exchange the induction melting furnace. Removal of the induction melting furnace in conventional vacuum induction melting assemblies requires a lengthy process because the furnace must remain in the vacuum chamber with cooling water flowing through the induction coil for an extended period of time, and because the power and cooling sources connections are manually disconnected. This conventional procedure for repair or exchange results in a significant loss of productivity caused by the required cooling time of the furnace along with the rather lengthy time normally required to manually disconnect and reconnect the induction furnace. It is desired that means be provided to allow for the rapid replacement of the crucible or for the rapid exchange of the induction melting furnace so as to reduce the attendant loss of productivity.

Accordingly, it is an object of the present invention to provide means for the rapid disconnection and reconnection of the required power and cooling connections for a vacuum induction furnace.

It is a further object of the present invention that this rapid disconnection and reconnection be simultaneously accomplished for all of the related connections.

Further still, it is an object of the present invention to provide means, internal to the vacuum induction melting assembly, that delivers cooling to the induction coil while the external cooling connectors are disconnected.

It is a still further object of the present invention to provide such rapid connection and disconnection means that are adapted to accommodate a tiltable vacuum induction melting assembly.

It is a further object of the present invention to provide convenient means for easily connecting or disconnecting an external assembly which provides for the tilting of the vacuum induction melting assembly.

It is still a further object of the present invention to provide rapid connection and disconnection means that allow for the removal of the cooling sources while at the same time preventing the disconnected coolant from entering the vacuum induction melting furnace.

SUMMARY OF THE INVENTION

The present invention is directed to an assembly that provides rapid and simultaneous connection and disconnection means that reduce the attendant loss of productivity normally occurring from the removal of the crucible or from the exchange of the induction melting furnace from a vacuum induction melting furnace.

The vacuum induction melting assembly of the present invention comprises a bearing, a trunnion, a first plurality of connectors rigidly mounted to the assembly and distributed about and inside the circumference of the trunnion. The assembly further comprises a housing which is positioned concentric with the trunnion, and which carries a second plurality of connectors for mating with the first plurality of connectors. The housing is moveable by a power activated device in a first direction toward and along the axis of the trunnion. Further, the housing is moveable by the power activated device in a second direction which is away from the trunnion but along its axis. The trunnion is rotatably supported on the bearing and has a pivotal axis about which the vacuum induction melting assembly is tiltable. The first plurality of connectors are interconnected to cables, such as tubular conductors, that conduct electrical power and carry a liquid coolant to and from the vacuum induction melting assembly. The second plurality of connectors have conduits or extensions, carried by the concentric housing, which are coupled to flexible cables that conduct electric power and carry liquid coolant to and from respective power sources. The movement of the concentric housing in the first direction causes the first and second plurality of connectors to be simultaneously engaged and creates a clamping force to be applied between the two types of connectors ensuring good electrical contact therebetween. Conversely, the movement of the concentric housing in the second direction causes the simultaneous disengagement of the first and second plurality of connectors.

Other objects, advantages and novel features of the present invention will become apparent from the following detailed description of the invention when considered in conjunction with the accompany drawings.

BRIEF DESCRIPTION OF THE DRAWING

For the purpose of illustrating the invention, there is shown in the drawings a form which is presently preferred; it being understood, however, that this invention is not limited to the precise arrangements and instrumentalities shown.

DETAILED DESCRIPTION OF THE PREFERRED EMBODIMENTS

Figure 1:
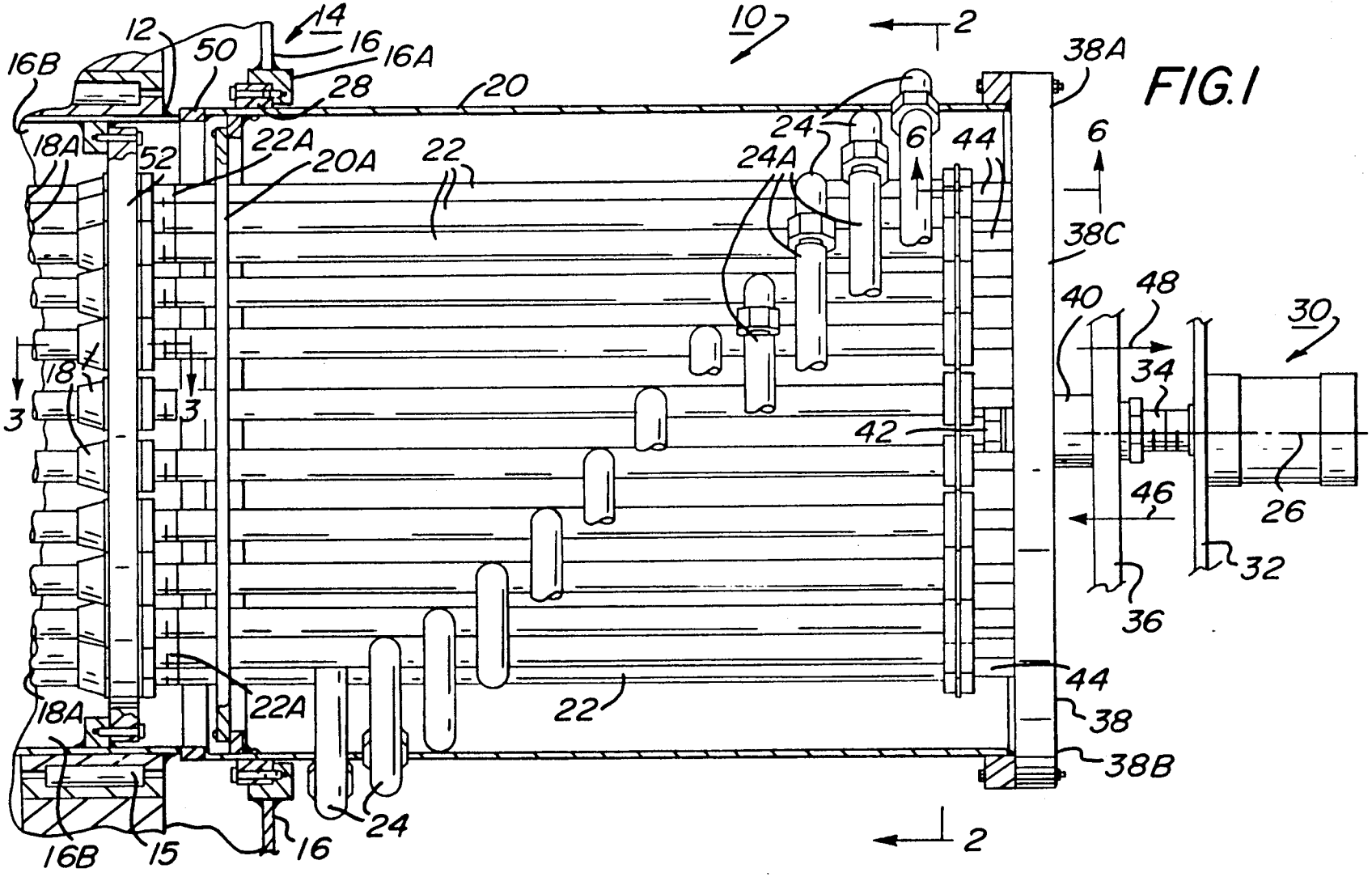
FIG. 1 is a side elevation view, partially broken away, primarily illustrating the power activated assembly of the present invention.

FIG. 1 is a side elevation view primarily illustrating the power activated assembly 10 of the present invention coupling to a trunnion 12 of a vacuum induction melting assembly 14. The vacuum induction melting assembly is an electrical heating device having an operation similar to that described in U.S. Pat. No. 2,433,495 of Vogel. The '495 patent discloses a trunnion which is rotatably supported on a bearing of the assembly. The induction type furnace of the assembly contains a crucible from which the final developed product of the furnace is poured out by tilting the trunnion with respect to the bearing. The function performed by the rotatable trunnion of the '495 patent is similar to that of the trunnion 12 shown in FIG. 1.

The vacuum induction melting assembly 14, partially shown in FIG. 1, of the present invention may have one or more trunnions on opposite sides of the assembly which are each an integral part of the assembly and are each supported by a bearing 15 preferably of a plain type. The one or more trunnions each have an axis. The axes are parallel to each other. For the embodiment shown in FIG. 1, a single trunnion 12 is illustrated which is supported by a respective bearing 15. The bearing 15 is located within the confines of a wall 16 having a flange 16A in which a vacuum seal 28 is mounted. FIG. 1 further shows the inside surface 16B of the trunnion 12.

A first plurality of connectors 18, preferably of the male type, are rigidly mounted to the melting assembly and preferably have water-cooled conductors 18A for conducting electrical power and carrying liquid coolant to and from the induction melting furnace. The conductors 18A are tubular conductors through which coolant flows. A housing 20 of the power actuated assembly 10 has a cross-member 20A positioned near the connectors 18. The cross-member 20A has bushings which guide a plurality of conduits or extensions 22 that are carried by the housing 20. The extensions 22 have a second plurality of connectors 22A (more clearly shown in FIG. 3 to be discussed), preferably of the female type, for mating with the male connectors 18. If desired, the connectors 22A may be a male type and connectors 18 may be a female type. The plurality of extensions 22 shown in FIG. 1 are interconnected to connectors 24 which, in turn, are connected to flexible cables 24A some of which are partially shown. The extensions 22, connectors 22A, connectors 24 and cable 24A are all preferably of the water-cooled type. As shown in FIG. 1, the extensions 22 are all of approximate equal length. The connections of extensions 22 to connectors 24 are shown in FIG. 2.

Figure 2:
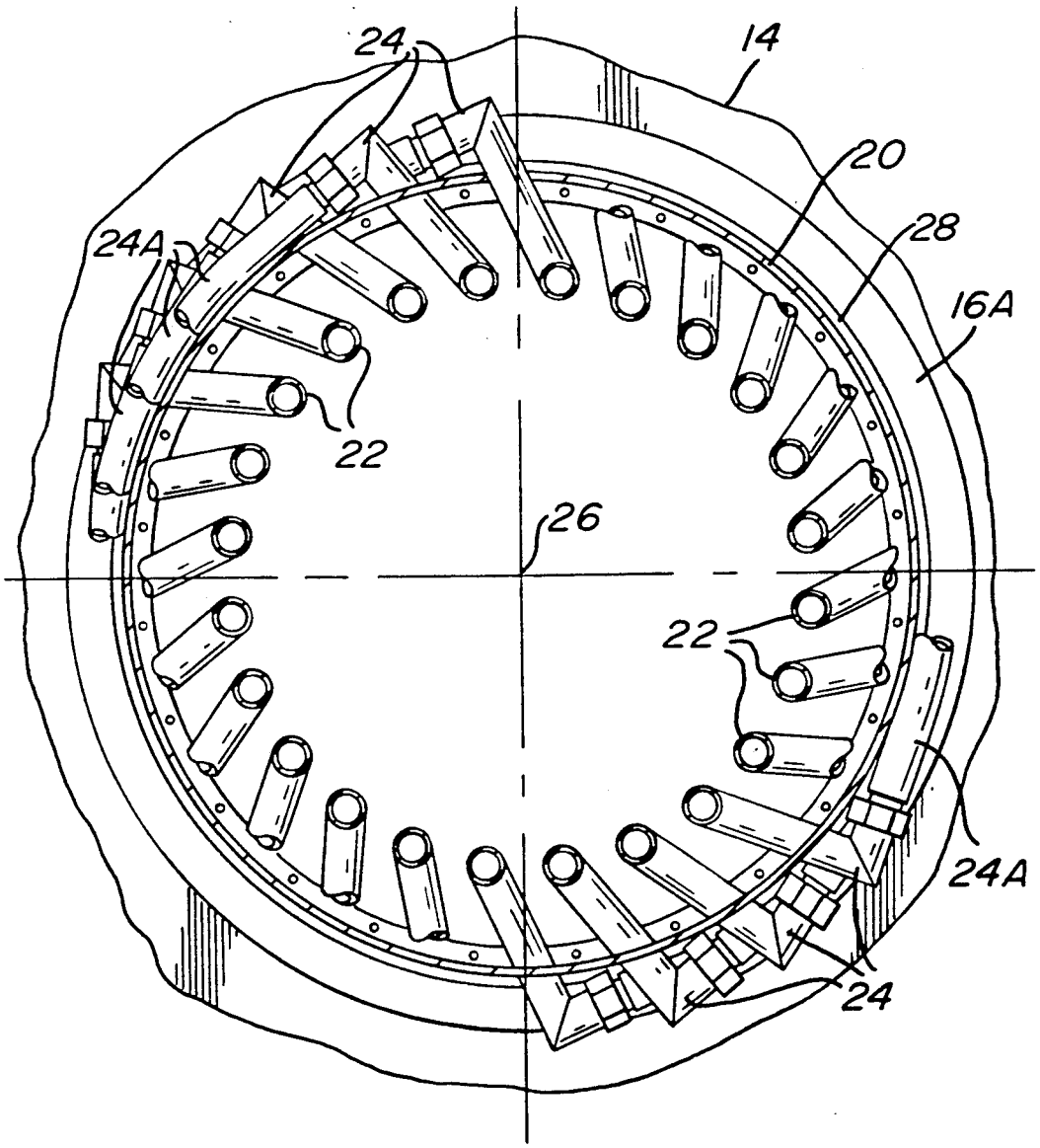
FIG. 2 is a sectional view along line 2—2 of FIG. 1 showing flexible cables connected to the extensions carried by the housing of the present invention.

FIG. 2 shows the housing 20 as being concentric with respect to the axis or centerline 26 of trunnion 12 (not shown) about which the trunnion 12 and housing 20 are tiltable. The housing 20 is positioned within the confines of a vacuum seal 28 which, in turn, is located within the confines of the lower member 16A of the vacuum wall 16 of FIG. 1. The extensions 22, shown in FIG. 2, are in direct alignment with and coaxial to the connectors 18 (shown in FIG. 1) so that both the connectors 18 and extensions 22 are distributed about and inside the circumference of the trunnion. The connectors 18 are rigidly connected to the vacuum induction melting assembly 14, partially shown in FIG. 2, and pivot or rotate with the trunnion 12. The connectors 18 do not rotate relative to the trunnion 12, but rather rotate as a rigid body. This rigid connection allows the cables 18A of connectors 18 to be of a rigid non-flexible type. Conversely, the cables 24A of connectors 24 are of the flexible type so that the housing 20 may be rotatable with the trunnion 12 about axis 26.

Figure 7:
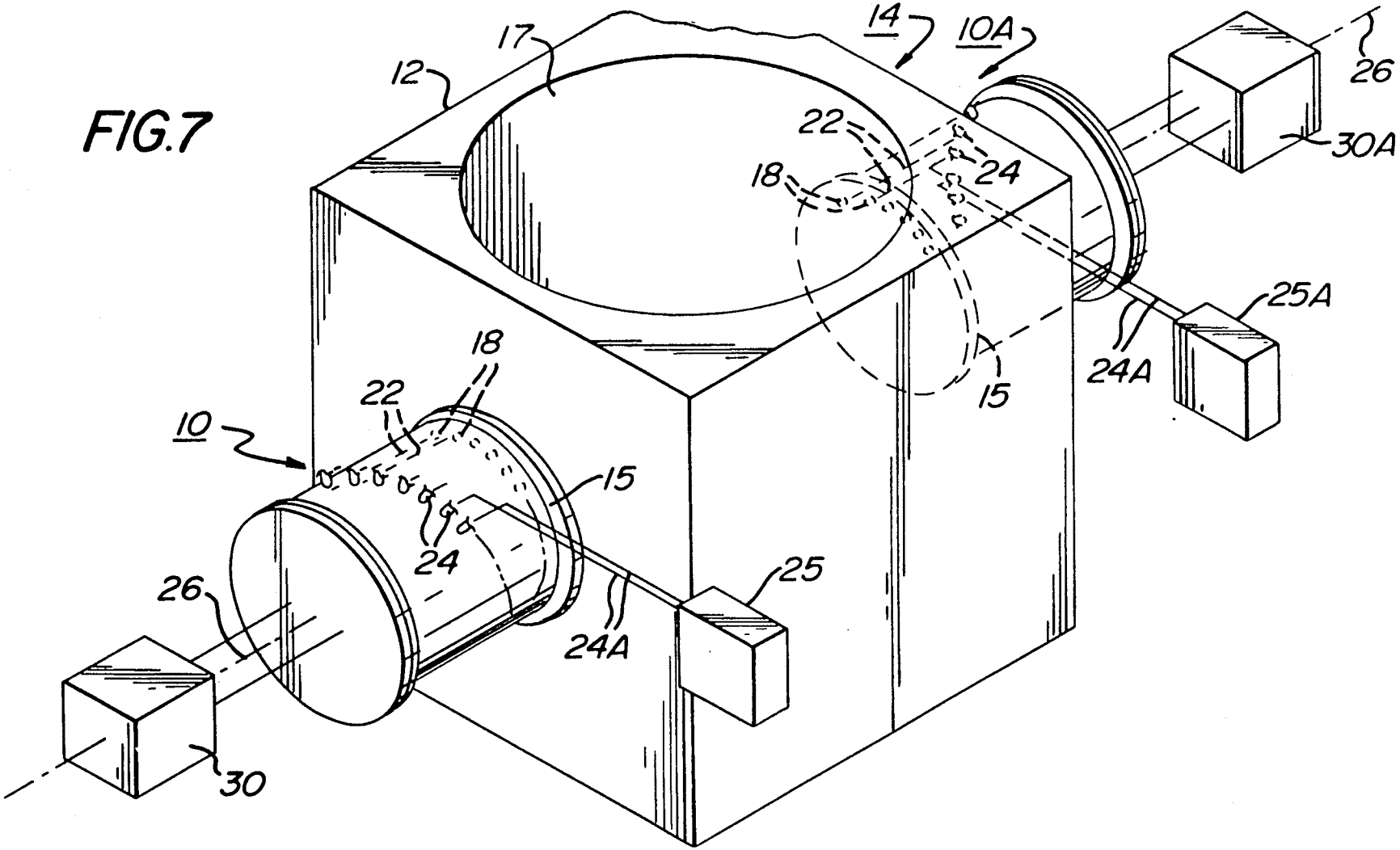
FIG. 7 is a functional illustration of a vacuum induction melting assembly showing at least two embodiments of the present invention.

A functional illustration of the vacuum induction melting assembly 14 of FIGS. 1 and 2 is shown in FIG. 7. The assembly 14 has a central portion which lodges the crucible, prevoiusly mentioned, about which is wound an induction heating coil, In operation, the heat generated by the induction coil melts the material contained within the crucible. The heating coil serves as an induction furnace for the assembly 14. The sources of power and cooling for the induction coil are made available by way of the housings 10 and 10A of the present invention.

FIG. 7 shows the first housing 10 located on one side of the assembly 14 and a second housing 10A located on the opposite of the assembly 14. For the embodiment shown in FIG. 7, the housings 10 and 10A are attached to single trunnion 12; however, for certain applications the housings 10 and 10A may be attached to separate trunnions. Still further, for one of the preferred embodiments a single housing 10 is arranged with the assembly 14.

FIG. 7 shows each of the housings 10 and 10A mated to the trunnion 12 by means of bearings 15 and 15A respectively. The housing 10 has a first plurality of connectors 18 distributed about and inside of the trunnion 12, more particularly, within the area bounded by the bearing 15 attached to the trunnion. Similarly, the housing 10A has a third plurality of connectors 18 distributed in the same manner as described for housing 10. The connectors 18 are to be more fully described with reference to FIG. 3.

The housings 10 and 10A each carry second and fourth, respectively, plurality of connectors 22A located at the ends of extensions 22. For the sake of clarity, the second and fourth plurality of connectors are not shown in FIG. 7, but are clearly shown in FIG. 3 to be described. The second and fourth plurality of connectors 22A respectively cooperate with the first and third plurality of connectors 18 of housings 10 and 10A.

FIG. 7 further shows the connectors 24, cables 24A and axis 26 all previously discussed with reference to FIG. 2. The cables 24A of housings 10 and 10A are connected to respective supplies 25 and 25A. FIG. 7 further illustrates motion control means 30 and 30A interconnected to housings 10 and 10A. The control means 30 and 30A may be operated separately or in unison to respectively control the movement of housings 10 and 10A along the axis 26. The motion control means 30 and 30A are to be more fully described hereinafter with reference to motion control means 30 of FIG. 1.

For the embodiment shown in FIG. 2, the vacuum induction melting assembly uses twenty-four (24) sets of water-cooled connectors 18, non-flexible conductors 18A, extensions 22, connectors 22A, connectors 24 and flexible cables 24A. In certain applications, additional connectors 18, conductors 18A, extensions 22, connectors 22A, connectors 24 and cables 24A that only carry water may be provided. Further, if desired, additional cabling components may be provided that are electrically conductive, and devoid of cooling provisions. In all cases, all such components (22, 22A, 24 and 24A) carried by housing 20 are arranged to be simultaneously moved along the axis 26 in response to motion control means such as a power activated device 30 shown in FIG. 1.

The device 30 is connected to and supported by member 32 (partially shown). The power activated device has an extending shaft 34 that is supported by a member 36 (partially shown). The support member 36 is interconnected to a cross-member 38 by means of a coupling member 40 having a member 42 for affixing member 38 to member 40. The cross-member 38 has upper 38A and lower 38B ends connected to the housing 20 while its middle portion 38C is connected to each individual extension 22 by respective ram means 44. The members 36 and 40 are interconnected by bearings (not shown). These bearings serve as the means for fixing all rotational and axial motion of member 40 which moves axially and rotationally relative to member 36. Members 32 and 36 are fixed devices, preferably connected to wall 16.

As will be discussed in further detail, the power activated device 30, when commanded to its active state, causes the movement, in a first direction 46, of the housing 20 toward the trunnion 12 and along the axis 26. This first movement engages and applies a clamping force between the connectors 18 and the connectors 22A. The clamping force ensures for a proper electrical connection between these connectors. When the power activated device is commanded to its deactivated state the housing 20 is moved, in a second direction 48, away from the trunnion 12 and along the axis 26. This second movement causes the connectors 22A to disengage from the connectors 18.

The end of the housing 20, nearest the trunnion 12, passes through the vacuum seal 28 situated at the vacuum chamber wall 16. The vacuum seal 28 is of a type which accommodates axial motion allowing the housing 20 to be moved along the trunnion axis 26. The axial movement allows connectors 22A to engage and disengage connectors 18. The vacuum seal 28 further accommodates rotary motion allowing the housing 20 to rotate with the trunnion for the normally occurring vacuum furnace tilting operation. When the housing 20 is moved to its most inward position in response to a fully extended shaft 34 of the device 30, a vacuum seal 50 is compressed, sealing the housing 20 against the end of the trunnion 12, and ensuring the vacuum containment of the vacuum induction melting assembly. The connectors 18, rigidly affixed to the melting assembly, pass from vacuum to atmosphere through a port 52 shown more clearly in FIG. 3.

Figures 3, 4:
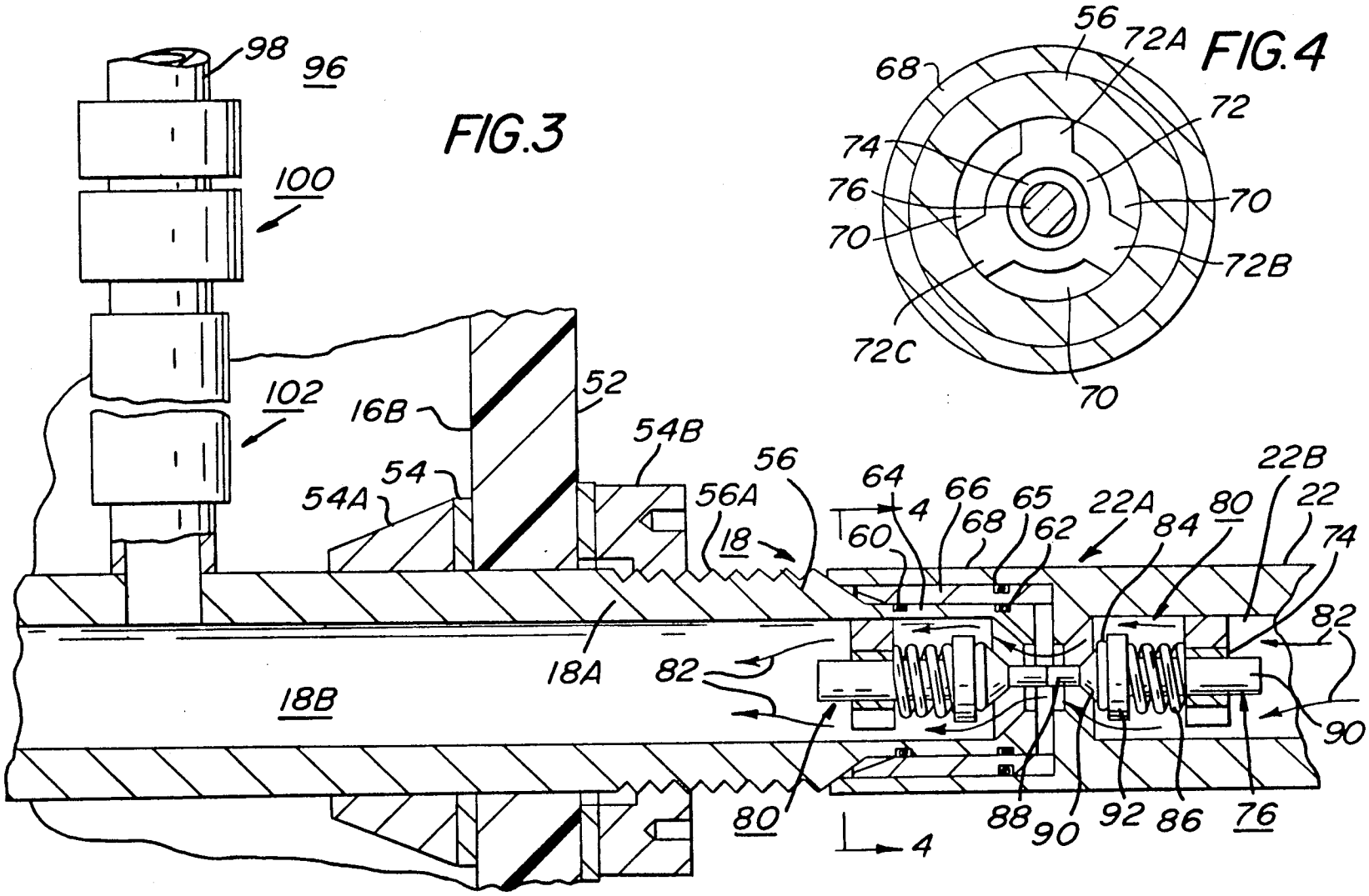
FIG. 3 is a sectional view, along line 3—3 of FIG. 1, showing details of the engaged connectors of the housing and vacuum induction melting assembly.
FIG. 4 is a sectional view, along line 4—4 of FIG. 3, showing a cross-section of the connector of the vacuum induction melting assembly.

The port 52 is formed of a dielectric material and has its interior surface 16B exposed to the vacuum while its exterior surface is exposed to atmosphere. FIG. 3 shows the mating of connectors 22A to the connectors 18 connected to port 52. A vacuum tight seal is effected between the port 52 and each of the connectors 18 by means of a respective sealing member 54. The seal member 54 is located between the port 52 and an abutment 54A which is preferably brazed to connector 18A. The connectors 18A are affixed to the port 52 by a nut 54B which cooperates with threads 56A formed in the outer surface 56 of each of the non-flexible cables 18A. Each of the connectors 18 has O-rings 60 and 62 seated in respective cut-outs of its section 64. A further 0-ring 65 is seated in a cut-out of a steel sleeve 66. The O-rings 60, 62, 65 and all related appurtenances form a water tight connection between elements 18A and 22. Each of the connectors 22A has an outer portion 68 into which the sleeve member 66 is inserted. The steel sleeve 66 provides a durable surface for O-ring 62 to seal against. In operation, as to be further discussed, each of the O-rings 62 slide on the inside diameter of the sleeve 66. The outer portion 68 of connectors 22A along with further details of each of the connectors 18 is shown in FIG. 4 which is a sectional view along line 4—4 of FIG. 3.

FIG. 4 shows the outer portion 68 of each of the connectors 22A circumferentially positioned about the outer surface 56 of the cable 18A. The outer portion 68 serves as the electrically conductive member for connector 22A and for the extension 22. The outer portion 68 has a protective coating (not shown) on its exterior surface. FIG. 4 further shows three segments 70 spatially disposed from each other that provide open spaces through which water flows. FIG. 4 further shows a member 72 having three legs 72A, 72B and 72C that supports a bushing 74 through which the shaft 76 of the shut-off valve slides. The body of the connector 18A is electrically conductive and provides significant contact surface between the two connectors 22A and 18 so as to conduct the required current to the induction furnace, whereas each of flow control means such as cut-off valves within each of the connectors 18 and 22A (to be described) has a concentric water seal to prevent water from passing through the connectors 18 and 22A when they are disengaged from each other. The control of the coolant water flow is preferably accomplished by shut-off valves 80 shown in FIG. 3.

FIG. 3 shows the shut-off valves 80 in their engaged state which allows the coolant water, shown by arrows 82, to flow from the internal cavity 22B of extension 22, through the connector 22A of extension 22, into the connector 18, past the internal cavity 18B of the cable 18A preferably being a tubular conductor through which coolant flows, and then into its final destination, the induction furnace (not shown). Each of the connectors 22A and each of the connectors 18 has a shut-off valve 80 positioned therein. For the sake of clarity only the reference numbers for the shut-off valve 80 located within connector 22A are shown in FIG. 3.

Each of the shut-off valves 80 of FIG. 3 comprises the shaft 76, an O-ring seal 84, and a coil spring 86. The shaft 76 has the guide bushing 74 positioned about its first end 90 so as to allow movement of the shaft within its respective central cavity 18B or 22B. The shaft 76 has a tapered portion 88 which extends out of the exit portion of its respective connector 18 or 22A. The shaft 76 further has an outwardly flared portion 90 which has a cut-out for seating the O-ring 84. The shaft 76 also has a cylindrical portion 92 having one side that forms part of the cut-out for the O-ring 84 and having its other side that provides for an abutment for contacting and confining the movement of one end of the spring 86. The spring 86 has its other end lodged against the guide bushing 74. The spring 86 of FIG. 3 is shown in its compressed operative condition caused by the extending portion 88 of each of the shut-off valves 80 in connectors 22A and 18 pressing against each other. This operative condition of the spring 86 allows the free passage of the coolant between the connectors 18 and 22A. The relaxed or non-operative condition of spring 86 is shown in FIG. 5.

Figure 5:
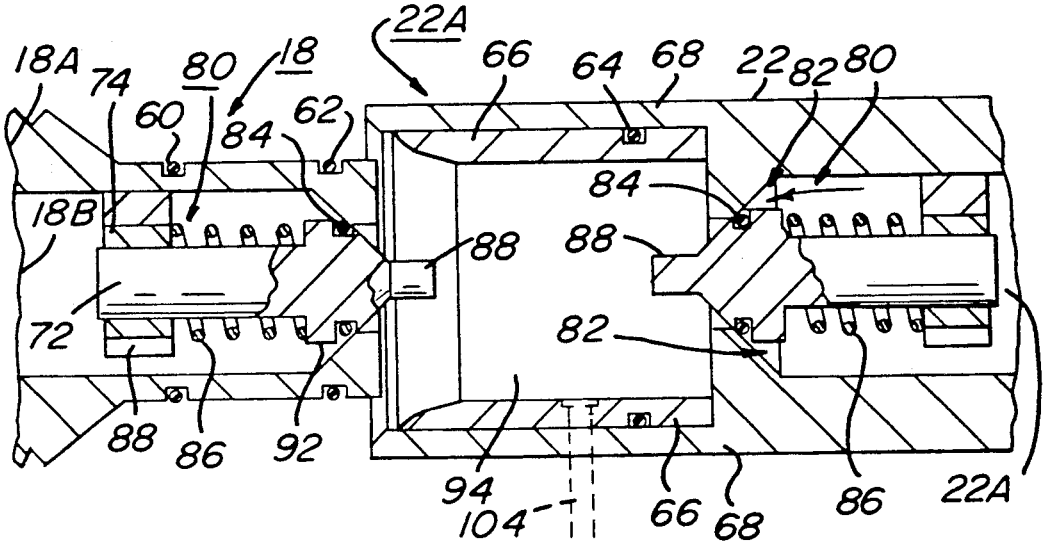
FIG. 5 is a cross section illustrating the disengaged connectors of the housing and the vacuum induction melting assembly.

FIG. 5 shows the shut-off valves 80 separated from each other and in a non-engaged position. More particularly, FIG. 5 shows the shut-off valve 80 of the connector 18 away from the cavity 94 of connector 22A. The shut-off valve 80 of connector 22A has its tapered portion 88 just entering the cavity 94. The cavity 94 of each of the connectors 22A has complementary dimensions that allow for a smooth insertion of the respective connector 18. For the sake of clarity, the reference numbers of the shut-off valve 80 are only shown associated with that of the connector 18.

The shut-off valves 80 in their non-engaged position allow their spring 86 to expand so that their respective O-ring 84 abuts up and seals against the exit portions of each of its respective connector 22A or 18, thereby preventing the coolant water from leaving its respective connector. The shut-off valve 80 provides an important feature of the present invention.

The connectors 18 and the connectors 22A, each preferably having the shut-off valve 80, provide for a significant reduction in the attendant loss of productivity of the vacuum induction melting assembly commonly created during the replacement of its ceramic crucible or the exchange of its induction melting furnace as discussed in the "Background" section. When it is desired to replace the crucible or to exchange the induction furnace, the connectors 22A are rapidly and simultaneously disengaged from the connectors 18, in response to device 30, causing the shut-off valves 80 to move away from each other and respectively shutting off the water flowing through their respective connectors. Water may then be supplied to the induction furnace to allow the furnace to cool down in a preplanned manner by means of auxiliary cooling means 96 shown in FIG. 3.

FIG. 3 shows the auxiliary means 96 coupled to the internal cavity 18B of conductor 18A which provides for the passageway for the coolant to the induction furnace. The auxiliary means 96 comprises a hose 98, a connector 100, and a second hose 102 which is electrically nonconductive and provides electrical isolation. The hose 98 is connected to a source of liquid cooling. The means 100 has its input stage coupled to the hose 98 and has a mechanism at its output stage that allows the passage of coolant when the hose 98 is connected, but seals itself when the hose 98 is disconnected. The means 102 allows the passage of the coolant when such is present and also provides electrical isolation between the electrically conductive portions of conductor 18A and connector 100 and the coolant that may be flowing therein.

An alternative method to supply coolant, during the removal of the crucible or during the exchange of the induction furnace, is to blow the water out of the induction furnace by using compressed air just prior to disconnecting the furnace so as to prevent any cooling water from draining from the connectors 18 and 22B into the vacuum chamber of the vacuum induction melting assembly. Air to blow out cooling water is admitted to the cooling water conduit at a remote location upstream of the disconnect assembly. In this embodiment, the shut-off valves 80 would not be installed, the auxiliary water connections 100 and 102 would likewise not be installed. Instead, after blowing the water out and removing the induction furnace a short distance from the vacuum induction melting assembly, auxiliary water connectors would be engaged to the connectors 18 to provide for the flow of cooling water during furnace cooling.

Figure 6:
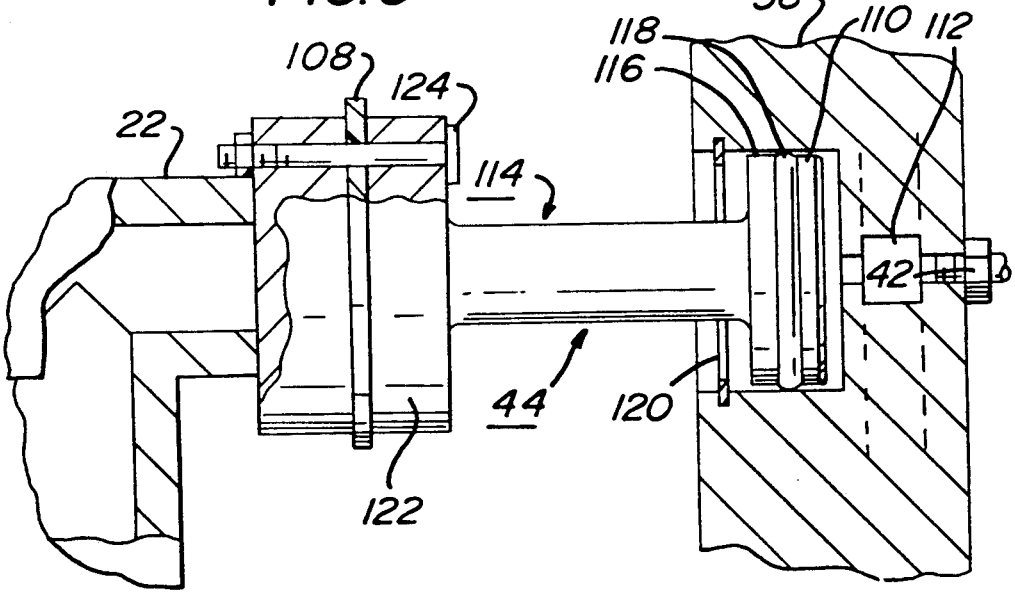
FIG. 6 is a sectional view, along line 6—6 of FIG. 1, showing the coupling between the extensions and concentric support member connected to the housing of the present invention.

A drainage passage 104 shown in FIG. 5 is provided to ensure that water which leaks during disconnect is kept away from the electrical contact surface. The passage 104 provides an exit from the cavity 94 through a passageway in the steel sleeve 66 and in the outer portion 68 of the connector 22A. The connectors 22 mate with connectors 18 and mating is controlled, in part, by the ram piston means 44 which may be further described with reference to FIG. 6.

Each of the connectors 22A are carried by respective extensions 22 that are rigidly affixed to the concentric housing 20 by way of a ram means 44 and cross-member 38. As previously discussed with reference to FIG. 1, the ram means 44 are individually connected to cross-member 38, which, in turn, is connected to the concentric housing 20. The extensions 22 are partially shown in FIG. 6 and each end of extensions 22 is individually connected to ram means 44 by an isolated joint 108. The support member 38 being connected to the housing 20 is concentric about the axis 26 of the trunnion 12 and cooperates in the movement of each individual extension 22 carrying connector 22A so that such movement is coaxial with its corresponding connector 18.

Each of the ram means 44, connected to the support member 38, comprises a cup member 110 that is operatively coupled to a conduit 112 containing hydraulic fluid which develops a pressure that is applied to ram means 44. The pressure applied to ram means 44 is independent of actuator 30. The purpose of ram means 44 is to act as a constant force spring which ensures that the same force clamps each of the connectors (18A and 22A) together. Ram means 44 further accommodate differences in the length of the connector assemblies which are a natural result of manufacturing practices. The distance that extension 22 moves in response to ram means 44 is substantially shorter than the distance that support member 38 moves in response to device 30.

The ram means 44 has piston-like shaft 114 having a first end 116 that carries an O-ring 118. The O-ring is positioned proximate to the cup member 110. The first portion 116 is further positioned near a snap-ring member 120. The movement of shaft 114 corresponds to the movements 46 and 48 of FIG. 1. The shaft 114, shown in FIG. 6, has a second end 122 which is connected to the isolated joint 108 by fastening means 124.

In operation, when the actuator 30 moves to disengage the connectors (18A and 22A), ram means 44 is fully extended such that the piston 110 moves into contact with the snap-ring 120.

It should now be appreciated that the practice of the present invention provides mean for rapidly and simultaneously disconnecting and connecting the coolant and power sources to and from the vacuum induction melting assembly. Such connection and disconnection operations reduce the attendant loss of productivity that would otherwise occur during the exchange of the induction melting furnace or during the repair of the refractory ceramic crucible.

It should be further appreciated that the auxiliary means of FIG. 3 may provide for the coolant flow during such an exchange or repair. Still further, compressed air may be applied to the induction furnace that blows out any residue water from the furnace just prior to the disconnection of connectors 18 and 22A. This compressed air prevents any coolant from finding its way into and possibly contaminating or damaging the vacuum chamber. After opening the disconnects (18 and 22A), the induction furnace may be moved a short distance from its vacuum chamber where cooling hoses can be connected to the induction furnace. This capability provides the removal of the induction furnace to a remote location allowing it to cool for the remaining duration of its desired cool-down period.

It is preferred that the vacuum induction melting assembly of the present invention be tilted by means of a rotary actuator located external to the vacuum chamber 16B and which transmits a rotary motion through a rotary vacuum seal such as the previously discussed rotary seal 15. The connection between the tilting mechanism and the vacuum induction melting assembly is preferably of the type that facilitates rapid connection and disconnection therebetween. One such arrangement is a tongue and groove joint wherein either the rotary actuator or the vacuum induction melting furnace has the tongue or the mating groove. In such an arrangement, the tongue and groove are arranged along the axis of the related trunnion and the tilting mechanism is placed on the side opposite from where the power activated assembly 10 of FIG. 1 is located. In this arrangement, the tongue and the groove are vertically oriented and correspond to the position at which the induction furnace of the vacuum induction melting assembly is in its level position. Such correspondence assists in the removal of the melting furnace from the tilting mechanism. More particularly, the vertical orientation allows for the induction furnace to be raised out of the vacuum chamber and which causes disengagement between the oriented tongue and groove joint.

Another arrangement for connecting the tilting mechanism to the vacuum induction melting assembly, is to attach a tilting mechanism, such as a rotary actuator, to the housing 20 of the present invention. For such an arrangement, means other than the connectors themselves need to be provided to transmit the torque of the actuator from the housing 20 to the trunnion 12. A tongue and groove connection may be used for this purpose.

For certain types of vacuum induction melting assemblies, two disconnect assemblies 10, each described and generally shown in FIG. 1, may be used on each side of the assembly. The axis of tilting for each assembly is parallel to each other. In such an arrangement, the tilting may be required to be done from both sides of the assembly. In this arrangement, the disconnect assembly 10 may be arranged to engage the trunnion 12 in a tongue and groove type of joint. For all the discussed arrangements tilting may also be accomplished by any suitable mechanism such as a lever arm interconnected to a hydraulic cylinder.

It should now be appreciated that the practice of the present invention provides for rapid and simultaneous connections and disconnections that facilitate the reduction of the attendant productivity loss commonly occurring during the removal of the crucible or the exchange of the induction furnace both of the vacuum induction melting assembly. Further, it should now be appreciated that the present invention provides for means for tilting the induction furnace that is easily connected and disconnected so as to further reduce the attendant loss in productivity commonly caused by such situations.

The present invention may be embodied in other specific forms without departing from the spirit or essential attributes thereof and, accordingly, reference should be made to the appended claims, rather than to the foregoing specification, as indicating the scope of the invention.

We claim:

1. A vacuum induction melting assembly having a vacuum chamber and lodging a crucible about which is wound an induction coil, said induction coil serving as an induction furnace of said vacuum induction melting assembly, said vacuum induction melting assembly comprising:

(a) a first bearing located on one side of said furnace;

(b) a first trunnion rotatably supported on said bearing, said trunnion having a pivot axis about which said crucible of said vacuum induction melting assembly is tiltable;

(c) a first plurality of connectors rigidly mounted to said assembly and distributed about and inside of said trunnion and within the area bounded by said bearing, said first connectors having conductors for conducting electrical power and carrying liquid coolant to and from said induction furnace of said assembly;

(d) a housing positioned concentric with said trunnion and rotatable about said pivot axis, said housing carrying a second plurality of connectors for mating with said first plurality of connectors, said second plurality of connectors being interconnected to extensions for coupling to flexible cables which conduct electric power and carry liquid coolant to and from respective supply sources;

(e) motion control means connected to said housing, said motion control means device when commanded to an actuated state causing the movement of said housing in a first direction toward said trunnion and along the pivot axis of said trunnion so as to engage and apply a clamping force between the first and second plurality of connectors, and said control means when commanded to a deactivated state causing the movement of said housing in a second direction away from said trunnion and along the pivot axis of said trunnion so that said first and second plurality of connectors become disengaged.

2. An assembly according to claim 1, wherein each of said first plurality of connectors is a tubular connector through which coolant flows.

3. An assembly according to claim 1, wherein said bearing is located within said vacuum chamber.

4. An assembly according to claim 1, wherein said first plurality of connectors is located on a port formed of a dielectric material, said port having its interior surface exposed to said vacuum chamber and its exterior surface exposed to atmosphere, said port providing a vacuum seal of each of said first plurality of connectors.

5. An assembly according to claim 1, wherein said housing is coupled to said trunnion through a vacuum seal means within said vacuum chamber, said vacuum seal means accommodating said movement of said housing in both said first and second directions along said pivot axis of said trunnion, said vacuum seal further accommodating said housing rotatable about said pivot axis of said trunnion.

6. An assembly according to claim 1, wherein said first plurality of connectors being male and said second plurality of connectors being of a female type, said first and second plurality of connectors and said extensions along with all of said conductors being water-cooled.

7. An assembly according to claim 1, wherein said first plurality of connectors being female and said second plurality of connectors being of a male type, said first and second plurality of connectors and said extensions along with all of said conductors being water-cooled.

8. An assembly according to claim 6, wherein said conductors for conducting electrical power and carrying liquid coolant of said first plurality of male connectors are rigid.

9. An assembly according to claim 6 wherein:

(a) each of said first and second plurality of connectors have disposed therein a flow control means comprising a shaft, an O-ring seal, a coil spring and a guide bushing;

(b) said shaft having said guide bushing positioned about its first end and allowing movement of said shaft in a central portion of a cavity of its respective connector, said shaft also having a tapered portion extending from its other end, said shaft having an outwardly flared portion merged to said tapered extending portion of said shaft, said flared portion having a cut-out for seating said O-ring, said shaft further having a rectangular portion with one side forming part of said cut-out and its other side providing an abutment for contacting one end of said spring, said spring having its other end abutting against said guide bushing, said spring in an extended condition causing said O-ring to contact an exit portion of said cavity of its respective connector.

10. An assembly according to claim 8, further comprising:

(a) auxiliary cooling means coupled to each of said cables of said first plurality of connectors comprising:

(i) a hose capable of being connected to a source of liquid coolant, (ii) a first connector for mating with said hose and having a mechanism for sealing itself when said hose is disconnected therefrom, and (iii) means for providing electrical isolation between said hose carrying said coolant and said cables of said first plurality of connectors.

11. An assembly according to claim 1, wherein said first plurality connectors are enclosed by a housing which passes through a vacuum seal and said housing is coupled to a rotary mechanism located external to said housing and which transmits rotary motion to said trunnion so as to cause tilting of said trunnion.

12. An assembly according to claim 11, wherein said rotary mechanism is connected to said trunnion by a tongue and groove joint that allows for said induction furnace, when in its level position, to be removed from said vacuum chamber.

13. An assembly according to claim 11, further comprising:

(a) a second bearing located on the opposite side of said furnace from said first bearing;

(b) a second trunnion rotatably supported on said second bearing, said second trunnion having a pivot axis parallel to the pivot axis of said first trunnion and about which said vacuum induction furnace is tiltable;

(c) a third plurality of connectors rigidly mounted to said assembly and distributed about and inside of said second trunnion and within the area bounded by said second bearing, said third plurality of connections having conductors for conducting electrical power and carrying liquid coolant to and from the induction furnace;

(d) a second housing positioned concentric with said second trunnion and rotatable about the pivot axis of said second trunnion, said second housing carrying a fourth plurality of connectors for mating with said third plurality of connectors, said fourth plurality of connectors interconnected to extensions for coupling to flexible conductors for conducting electrical power and carrying liquid coolant to and from respective supply sources; and (e) second motion control means connected to said second housing, said second motion control means when commanded to an activated state causing the movement of said second housing in a first direction toward said second trunnion and along the pivot axis of said second trunnion so as to engage and apply a clamping force between said third and fourth plurality of connectors, and second control means when commanded to a deactivated state causing the movement of said second housing in a second direction away from said second trunnion and along the pivot axis of said second trunnion so that said third and fourth plurality of connectors become disengaged.

14. An assembly according to claim 13, wherein said third plurality of connectors are enclosed by a third housing which passes through a vacuum seal and said third housing is coupled to a second rotary mechanism located external to said third housing and which transmits rotary motion to said second trunnion so as to cause tilting of said second trunnion.

15. An assembly according to claim 14, wherein said second rotary mechanism is connected to said second trunnion by a tongue and groove joint that allows said vacuum induction furnace, when in its level position, to be removed from said vacuum chamber.

16. An assembly according to claim 2, wherein each of said extensions of said housing are of approximately equal length and each has an isolate joint on its end which is opposite to the first plurality of connectors.

17. An assembly according to claim 15, wherein each of said extensions are rigidly affixed to a support member by respective ram means, and said support member is connected to said housing that is positioned concentric with said trunnion.

18. An assembly according to claim 16, wherein said ram means comprises:

(a) a cup member for coupling to a conduit containing a hydraulic fluid, said cup member being moved in response to pressure developed by said hydraulic fluid; and (b) a piston-like shaft having a first end carrying an O-ring positioned proximate to said cup member, said first end also being positioned near a snap-ring, such shaft having a second end connected to the isolation joint of each of said extensions of said housing by a fastening means.

* * * * *